US008458966B2

(12) United States Patent
O'Toole

(10) Patent No.: US 8,458,966 B2
(45) Date of Patent: Jun. 11, 2013

(54) POST BRACKET

(75) Inventor: Lawrence O'Toole, Raworth (AU)

(73) Assignee: Onesteel Wire Pty Limited, Sydney NSW (AT)

( * ) Notice: Subject to any disclaimer, the term of this patent is extended or adjusted under 35 U.S.C. 154(b) by 0 days.

(21) Appl. No.: 13/027,842

(22) Filed: Feb. 15, 2011

(65) Prior Publication Data

US 2011/0197542 A1 Aug. 18, 2011

(30) Foreign Application Priority Data

Feb. 16, 2010 (AU) ..... 2010900625

(51) Int. Cl.
*E04H 12/20* (2006.01)

(52) U.S. Cl.
USPC ..... 52/146; 248/219.4; 248/534; 248/530

(58) Field of Classification Search
USPC ..... 52/741.14; 248/219.4, 534, 530
See application file for complete search history.

(56) References Cited

U.S. PATENT DOCUMENTS

| | | | | | |
|---|---|---|---|---|---|
| 2,826,281 | A | * | 3/1958 | Johnson | 52/158 |
| 2,930,638 | A | * | 3/1960 | Morrissey | 403/217 |
| 3,498,576 | A | | 3/1970 | Alissandratos | |
| 3,785,107 | A | * | 1/1974 | Garretson | 52/514 |
| 3,820,758 | A | * | 6/1974 | Berg, Jr. et al. | 256/10 |
| 4,077,611 | A | * | 3/1978 | Wilson | 256/10 |
| 4,682,761 | A | * | 7/1987 | Hanneken | 256/36 |
| 4,712,762 | A | * | 12/1987 | Liedle | 248/533 |
| 4,763,879 | A | * | 8/1988 | Wasicek et al. | 256/36 |
| 4,889,322 | A | * | 12/1989 | Wagner | 256/36 |
| 4,936,550 | A | * | 6/1990 | Wickham et al. | 256/36 |
| 4,979,724 | A | * | 12/1990 | Williams | 256/36 |
| 4,982,932 | A | * | 1/1991 | Baker | 256/47 |
| 4,986,513 | A | * | 1/1991 | Schultz et al. | 256/65.06 |
| 5,042,780 | A | | 8/1991 | Yearwood | |
| 5,104,074 | A | * | 4/1992 | Malloy | 248/156 |
| 5,240,230 | A | * | 8/1993 | Dougherty | 256/31 |
| 5,356,101 | A | * | 10/1994 | Malloy | 248/156 |
| 5,460,344 | A | * | 10/1995 | Malloy | 248/156 |
| D364,794 | S | | 12/1995 | Eberschlag | |
| 5,518,333 | A | * | 5/1996 | Cienkus et al. | 403/169 |
| 5,593,143 | A | * | 1/1997 | Ferrarin | 256/68 |
| 5,791,635 | A | * | 8/1998 | Hull et al. | 256/64 |
| 5,803,426 | A | * | 9/1998 | Hart | 248/523 |
| 5,996,973 | A | * | 12/1999 | Campbell | 256/35 |
| 6,298,618 | B1 | * | 10/2001 | Lawson | 52/292 |
| 6,340,151 | B1 | * | 1/2002 | Snow | 256/65.05 |
| 6,406,003 | B1 | * | 6/2002 | Shaw | 256/36 |
| 6,511,034 | B2 | * | 1/2003 | Nicholson et al. | 248/523 |
| 6,563,055 | B1 | * | 5/2003 | Burdick | 174/158 F |

(Continued)

FOREIGN PATENT DOCUMENTS

WO 2007070924 A1 6/2007

*Primary Examiner* — Mark Wendell
(74) *Attorney, Agent, or Firm* — The Webb Law Firm

(57) ABSTRACT

A bracket for a post comprises a body adapted for being located at the post and at least one projection extending out from the body. The projection is adapted for retaining thereat at least one of a ground securing pin and an end of a tensioning rod. A post securement system comprises the bracket and at least one of the ground securing pin and tensioning rod. A method employing the bracket locates the post in ground, locates the bracket along the post and positions at least one of the ground securing pin and tensioning rod to be retained at the bracket.

31 Claims, 11 Drawing Sheets

U.S. PATENT DOCUMENTS 6,583,363 B1 * 6/2003 Wilson, Jr. ..... 174/158 F
6,899,320 B1 5/2005 Wallace
7,070,136 B1 * 7/2006 Bailey ..... 241/260.1
2003/0062515 A1 * 4/2003 Pettigrew ..... 256/40
2005/0127346 A1 * 6/2005 Steffes ..... 256/65.05
2010/0078613 A1 * 4/2010 Payne ..... 256/24

* cited by examiner

POST BRACKET

TECHNICAL FIELD

A bracket for a post, and a system and method employing the bracket, are disclosed. When mounted to the post, the bracket can help to facilitate additional securement of the post (i.e. enabling it to be better secured in ground). Additionally or alternatively, the bracket can function to locate an end of a tensioning rod of a strainer assembly to the post (i.e. instead of attaching the rod directly to the post).

The post can be of a type employed in fencing applications. For example, a particular though not exclusive form of the post is as a strainer post that is employed at a fence terminus. The bracket will, at least to some extent, be described in a fencing context, but it is to be understood that the bracket and post are not in any way limited to such applications.

In addition, the term "post" as employed herein is to be broadly interpreted, in that the bracket can be mounted to a variety of elongate members including upright posts (such as employed in fencing); rails; cross-members; struts; stays; channels; etc.

BACKGROUND ART

A strainer post is employed at a fence terminus as part of a strainer assembly. Strainer assemblies bear the weight and strain of the fence (e.g. one of the various forms of fence wiring). In addition, strainer assemblies need to be resistant to impact from animals (e.g. cattle) and from farm equipment. Further, accessories such as gates may need to be supported at strainer posts.

Posts to be used in applications other than agriculture may also require a high level of securement of the post in the ground.

The above references to the background art do not constitute an admission that such art forms a part of the common general knowledge of a person of ordinary skill in the art. The above references are also not intended to limit the application of the bracket disclosed herein.

SUMMARY OF THE DISCLOSURE

In a first aspect there is disclosed a bracket for a post. The bracket can help to facilitate additional securement of the post in the ground and/or of the post to a strainer assembly. The post can be of a type employed in fencing applications and, for example, can take the form of a strainer post, though it is not in any way intended to be limited to such an application.

The bracket comprises a body adapted for being located at the post, and at least one projection extending out from the body. The at least one projection is adapted for retaining thereat at least one of a ground securing pin and an end of a tensioning rod.

Thus, when the bracket is located adjacent to (or in) the ground at the post, the pin can be secured at the bracket when it is driven into the ground, to improve post retention and securement in the ground. Additionally or alternatively, the projection can function to locate an end of a tensioning rod of a strainer assembly to the post (i.e. instead of attaching the rod directly to the post). In this respect, the one bracket or even the one projection can be adapted to provide both pin securement and rod end retention, optionally simultaneously. Alternatively, separate respective brackets that are located in-use adjacent to each other can be employed for pin securement and rod end retention.

In one embodiment the bracket can comprise at least two primary projections extending out from the body. The primary projections can each provide a pin securement function. Each such primary projection can extend out from the body in a direction that is offset by approximately 90° to the direction of the other such primary projection. Each such primary projection can be adapted for receiving therethrough and retaining thereat a respective ground securing pin. In use, the bracket can be secured at the post and a pin can be received and retained in each such primary projection to extend into the ground.

The primary projections can be arranged on the body such that, when the post is viewed in end profile, adjacent pins in adjacent primary projections can extend at an angle to each other. For example, the adjacent pins can extend generally at right angles to each other. This angling of the pins to each other can further contribute to securement of the pins, and thus better secure the post, in the ground.

In one embodiment the bracket can comprise up to four secondary projections extending out from the body. The secondary projections can each provide a tensioning rod end securement function. Each such secondary projection can extend out from the body in a direction that is offset by approximately 90° to the direction of the other such secondary projection. Each such secondary projection can be adapted for receiving the end of the tensioning rod in a slot defined in the projection intermediate its ends. In use, the bracket can be secured at the post and a rod end can be received and retained in a given one of the secondary projections.

When four secondary projections are arranged on the body, and when the bracket is mounted on the post and is viewed in end profile, the secondary projections can be spaced at 90° intervals around the post (i.e. so that the most suitably located secondary projection can receive and retain the rod end therein).

In one form the body is able to be slid along and then secured against movement with respect to the post. This makes for easy mounting of the bracket to a post.

For example, the body can take the form of a collar having an aperture therethrough that is sized to snugly receive the post therein and such that the collar can be slid along and secured to the post at a given position. The collar can be a split collar, such that it can be tightly slide-fitted to the post.

When the post is circular (e.g. in the form of a tube) the collar can be circular, and may comprise a circular aperture therethrough to enable it to be slidably positioned along the circular post. However, different aperture configurations can be adopted in the collar to suit different post profiles.

To enable the collar to be secured against sliding movement with respect to the post, the collar can comprise one or more locator holes. Each locator hole can receive e.g. a self-tapping screw therethrough that taps into the post. Alternatively, each hole can be adapted (e.g. threaded) for receiving a securing screw (e.g. a grub screw) therethrough. The post can also comprise one or more corresponding locator holes for lining up with the collar locator holes and receiving the securing screw.

In another alternative, the body may be adapted for being clipped or clamped onto the post, rather than being slid onto the post.

In one form, the (or each) projection can comprise a strip of material (e.g. a weldable metal such as steel) that defines a loop. For simplicity the strip can e.g. be welded at its ends to an external surface of the bracket body. The loop in turn defines an aperture for receipt of the ground securing pin therethrough or the tensioning rod end therein.

In one embodiment, for the primary projections, the loop can be oriented such that, when the bracket is mounted to an elongate post, a centreline through the loop aperture extends downwardly and at an angle with respect to a longitudinal axis of the post. This orientation can set an angle for a pin positioned in the loop to be driven into the ground (i.e. ensuring a skewed orientation of the pin such that it can be skew-driven into the ground).

In one embodiment, for the primary projections, when viewed from its opening, the loop can define a generally triangular-shaped aperture. The general triangular-shape can extend right through the projection. Such a shape can be adapted to a pin in the form of a bar that has a Y-profile or a T-profile (e.g. a Y- or T-profile formed from a discrete length of fence post). Thus, as the ground securing pin, the bracket can make use of a known-fence post profile.

In one embodiment, for the secondary projections, the loop can be oriented such that, when the bracket is mounted to an elongate post, a centreline through the loop aperture extends parallel to the post longitudinal axis.

In one embodiment, for the secondary projections, when viewed from its opening, the loop can define a generally trapezoidal-shaped aperture. The general trapezoidal-shape can extend right through the projection. Such a shape can be adapted to the end of a tensioning rod used in stay assemblies.

In an alternative configuration, the primary and secondary projections may take the form of a lug, with each lug being adapted either to retain the pin or the tensioning rod end at the body in use.

In a second aspect there is disclosed a post securement system. The system comprises at least one bracket as set forth in the first aspect. The system also comprises at least one of a ground securing pin and tensioning rod for retention at the bracket.

In this regard, the system may comprise the bracket and either or both of the pin and tensioning rod. Optimally, a single bracket may serve to secure both pin and rod, or separate brackets can be supplied for retaining each at the post. The bracket works together with the pin and tensioning rod to facilitate additional securement of the post in the ground and to the strainer assembly.

In the system the (or each) ground securing pin can be formed from a discrete length of fence post having e.g. a Y-shaped or a T-shaped profile. In the system the tensioning rod can be formed from a discrete length of externally threaded metal rod.

The system of the second aspect can further comprise a post (e.g. a post that is suitable for use with the bracket). Again, the post can be of a type employed in fencing applications such as, for example, a strainer post, though is not so limited. In this regard, the post may be tubular, or may be roll-formed with a Y-shaped or a T-shaped profile, etc. The bracket body can then be appropriately adapted to the post.

In the system the post can be adapted such that, when it is located in the ground, the bracket can be located at the post adjacent to or in the ground. In such case, the at least one ground securing pin can be retained at the bracket and can also be easily inserted into the ground. Also, in such case, the (or each) tensioning rod end can be easily attached to the post via the bracket.

As with the first aspect, the bracket employed in the system of the second aspect can be adapted for retaining at least two ground securing pins to be inserted into the ground and e.g. one or two tensioning rods. The pins can generally project at e.g. right angles to each other (i.e. when the post is viewed in end profile).

As with the first aspect, in the system of the second aspect the adjacent projections can be oriented such that, in use, an elongate axis of each pin extends downwardly and at an angle with respect to the post longitudinal axis.

In a third aspect there is disclosed a method of securing a post in ground. The method can make use of the bracket, ground securing pin and tensioning rod of the first aspect. The bracket, pin and rod can be employed together to facilitate additional securement of the post in the ground and to a strainer assembly. In the method the (or each) pin may again be formed from a discrete length of fence post having a Y-shaped or T-shaped profile. In the method the tensioning rod can be formed from a discrete length of externally threaded metal rod. The post can be of a type employed in fencing applications such as, for example, a strainer post.

The method of the third aspect comprises the steps of:

(i) locating the post in the ground;

(ii) locating the bracket along the post adjacent to the ground;

(iii) positioning at least one ground securing pin to be retained at the bracket and also to be inserted into the ground and/or positioning at least one tensioning rod to be retained at the bracket.

In step (ii) of the method the bracket body can be inserted over a top end of the post. The post is thus received though an aperture of the body, and then the bracket is slid along the post until it sits adjacent to or at least partially in the ground, whereupon the bracket is secured to the post against sliding. Alternatively, the body may be clipped or clamped (or otherwise secured) onto the post adjacent to or in the ground, rather than being slid onto the post.

In step (iii) of the method the (or each) ground securing pin can be inserted through (or retained at) a respective primary projection and be driven into the ground (e.g. with a hammer or like tool). In step (iii) of the method the end of the (or each) tensioning rod can be inserted into a slot defined in a respective secondary projection.

BRIEF DESCRIPTION OF THE DRAWINGS

Notwithstanding any other forms which may fall within the scope of the bracket, system and method as defined in the Summary, specific embodiments will now be described, by way of example only, with reference to the accompanying drawings in which.

DETAILED DESCRIPTION OF SPECIFIC EMBODIMENTS

Figure 1A:
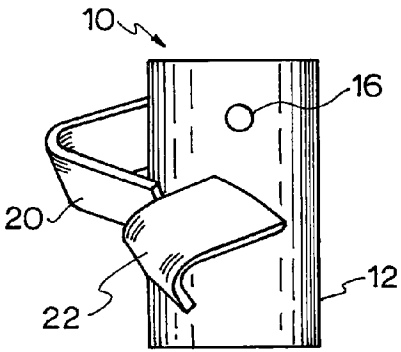
FIGS. 1A to 1E respectively show front, plan and three perspective views of a first bracket embodiment.
Figure 1B:
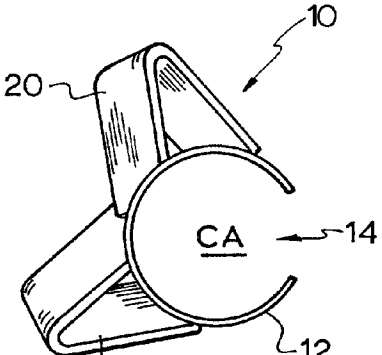
Figure 1C:
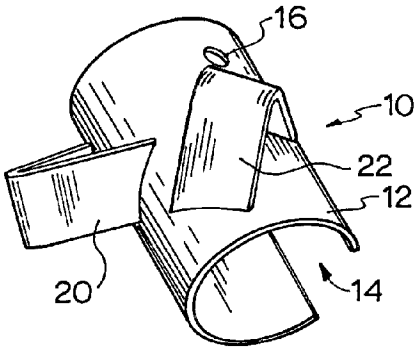
Figure 1D:
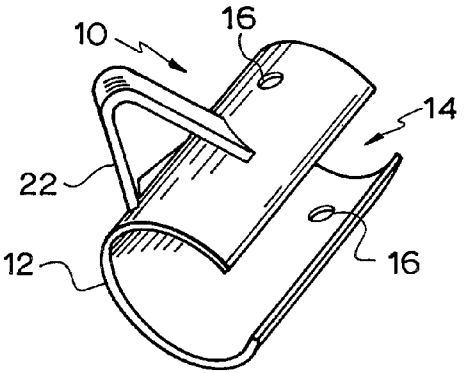
Figure 1E:
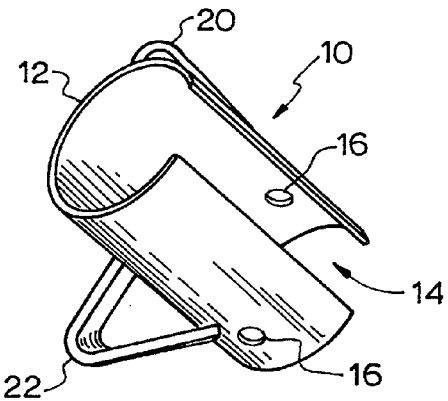
Figure 2C:
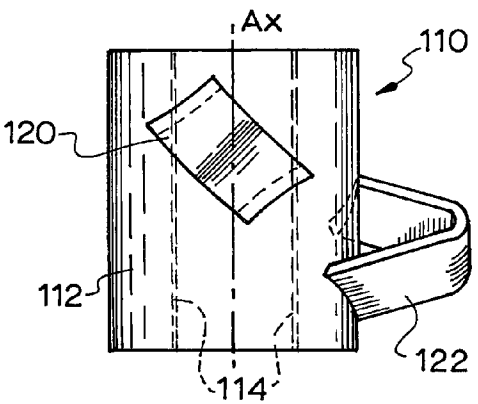
FIGS. 2A to 2C respectively show plan, front and side views of a second squat bracket embodiment, with FIGS. 2D to 2F showing end and two sectional views of a lug for the bracket of FIGS. 2A to 2C.
Figure 2F:
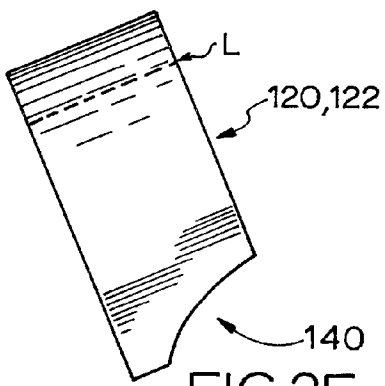
Figure 2B:
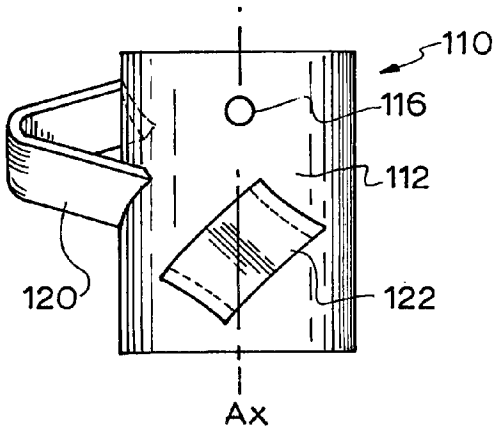
Figure 2E:
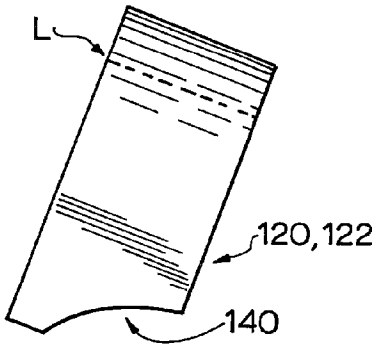
Figure 2A:
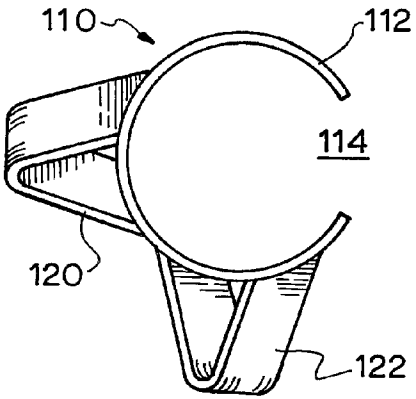
Figure 2D:
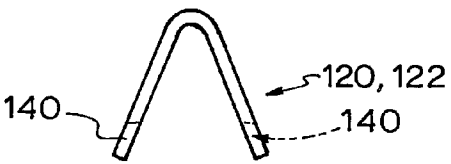

Referring firstly to FIGS. 1A to 1E a first bracket embodiment for a post is shown in the form of a retention bracket 10. The bracket 10 can be formed from pre-galvanised steel. For example, the bracket can be bent from galvanised plate/strip steel, with pre-galvanised projections either having first been welded thereon or welded thereto after bending. Alternatively, the bracket can be formed into the configuration shown in FIG. 1 and then galvanised (e.g. hot dipped).

A primary application of the bracket 10 is to help facilitate additional securement, such as anchoring, of a post in the ground. For example, the post can be of a type that is employed in fencing applications. In one application the post can take the form of a strainer post, though it is not in any way intended to be limited to such an application. The post can be of a galvanised steel tube or pipe 30, 130 (FIGS. 5A-E).

The bracket 10 comprises a body in the form of a collar 12 for location at the post. The collar 12 has an aperture CA therethrough that is sized to snugly receive the post therein. The collar is of a split-type, i.e. split at 14, to enable it to expand and to be tightly slide-fitted to the post. In this regard, the collar can be slid along and secured to the post at a given position, which in use is usually part-way into the ground G (see FIGS. 8 and 9). The collar 12 comprises a section of 3 mm steel plate that has either been rolled (e.g. around a pipe) or cut from a circular section, but in either case so that is conforms with the outside shape and size of the post.

For a post in the form of a circular tube or pipe 30, 130 (e.g. of say 80 mm or 100 mm nominal bore (NB)—80 NB in FIG. 5) the collar 12 comprises a circular aperture therethrough having an internal diameter at or just greater than the external diameter of the 80 NB or 100 NB tube or pipe, to enable it to be slidably positioned along the tube or pipe and secured/fitted thereto. The nominal bore changes according to the tube or pipe thickness, but typically an 80 NB tube or pipe will have an outside diameter (OD) of 88.9 mm with each of a wall thickness of 4.0, 5.0 & 5.9 mm, and a 100 NB tube or pipe will have an OD of 114.3 mm with a wall thickness of either 4.5 or 5.4 mm. However, the bracket configuration shown can be adapted and employed across a wide range of tube and pipe sizes.

Once desirably located, and to enable the collar to be secured against sliding movement with respect to the post in use, the collar comprises opposed locator holes 16. A self-tapping screw can be driven through each locator hole to tap into the post. These holes 16 can align with suitably located holes in the tube 30, 130 described hereafter. Alternatively, each hole can e.g. be threaded for receiving a securing screw (e.g. a grub screw) therethrough to fasten against the tube.

Different aperture configurations can be adopted in the collar to suit different post profiles (e.g. triangular, square, rectangular, oval, pentagonal, hexagonal, etc).

In another variation, the body may take the form of a clamp for being clipped or clamped (e.g. via a screw mechanism) onto the post, rather than being slid onto the post via an end thereof.

Figure 9:
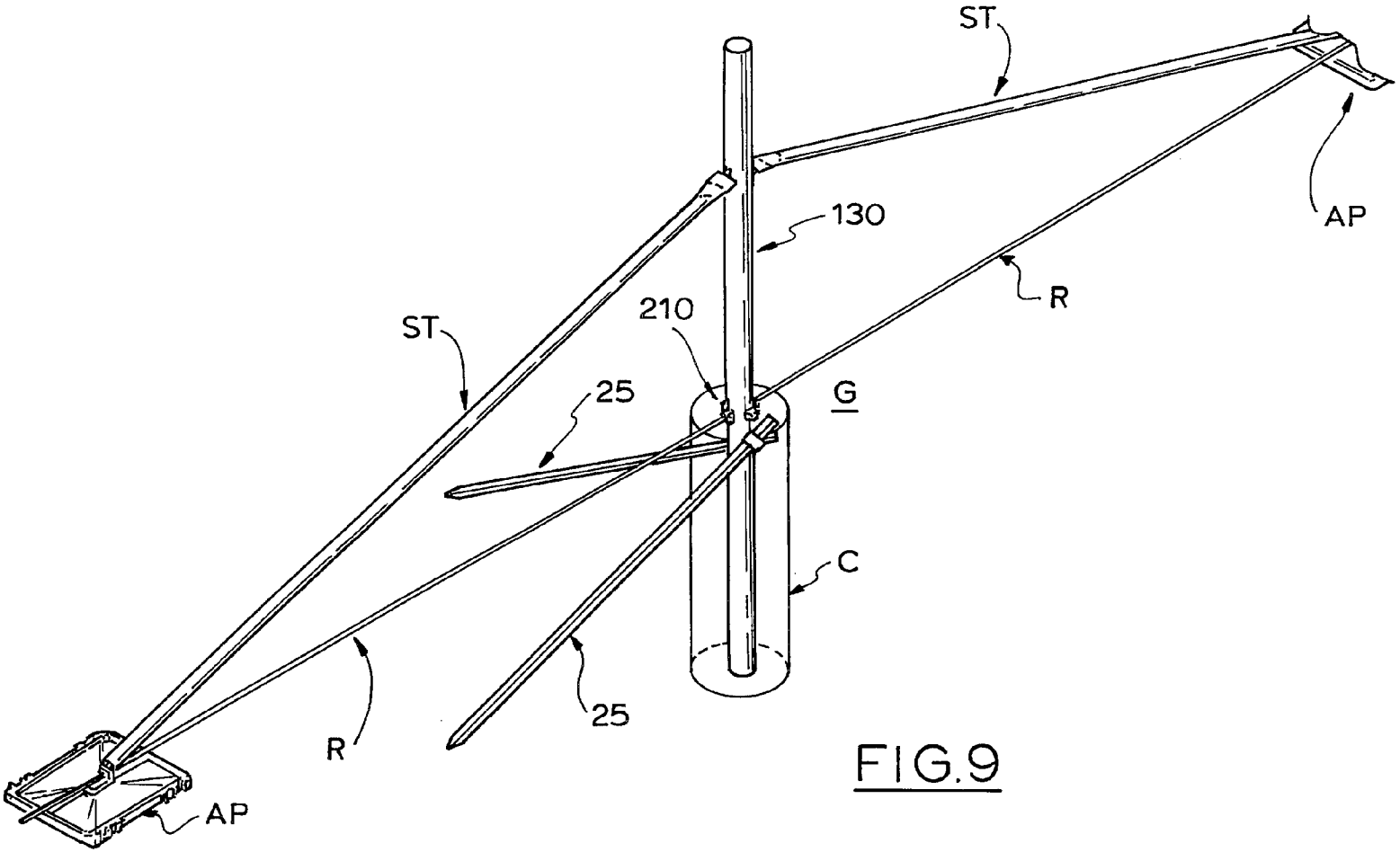
FIG. 9 shows a perspective view of a second (duel) stay assembly employing the bracket of FIG. 3 and post of FIG. 6.

The bracket 10 further comprises at least one primary projection which, in the embodiments depicted, takes the form of two lugs 20, 22 extending out from the collar. Each lug is configured for retaining a respective ground-securing pin 25 thereat. Each lug 20, 22 allows its respective pin 25 to be secured at the bracket when the bracket is located on the post adjacent to the ground G (FIGS. 6, 7 & 9). When each pin 25 is driven into the ground (e.g. by a suitable tool such as a hammer or mallet), this notably improves post securement (anchoring) in the ground.

The lugs 20, 22 are adapted for retaining an upper end of the pin 25 once the pin has been driven into the ground. In addition, the lugs 20, 22 are adjacently arranged on the collar 12 such that, when the post is viewed in end profile, the pins extend at an angle to each other. In the embodiments shown in FIGS. 6, 7 & 9, the pins extend generally at right angles (90°) to each other. This angling of the pins further contributes to the securement (anchoring) of the post in the ground.

As shown in FIG. 4, each lug 20, 22 can be formed from a strip S of material (e.g. a weldable metal such as steel) that is shaped with two cut-outs CO at opposing ends thereof. The strip is then bent to define the loop shown in FIGS. 4A-C, which is subsequently welded to the collar 12 (either before or after forming its collar shape). The strip S shown in FIG. 4 comprises 6 mm thick steel flat bar (of 40 mm width and 163 mm length). The strip can be pressed/bent into the loop shape. In an alternative, the strip can be profiled out of sheets of steel plate and then pressed to shape.

In either case, after the lugs are welded to the external surface of the collar 12 they provide enough clearance to drive a pin 25 in the form of a Y-bar (or star post) therethrough to further anchor the pipe/tube into the ground, Typically the Y-bar is formed from a discrete length of Y- or T-profiled fence post. In this regard, when viewed from its opening, the loop defines a generally triangular-shaped aperture TA right through the lug (FIG. 4B) which is especially suited to a Y-bar. Thus, the ground securing pin 25 can be supplied from existing fence post stock cut to length.

Figure 6D:
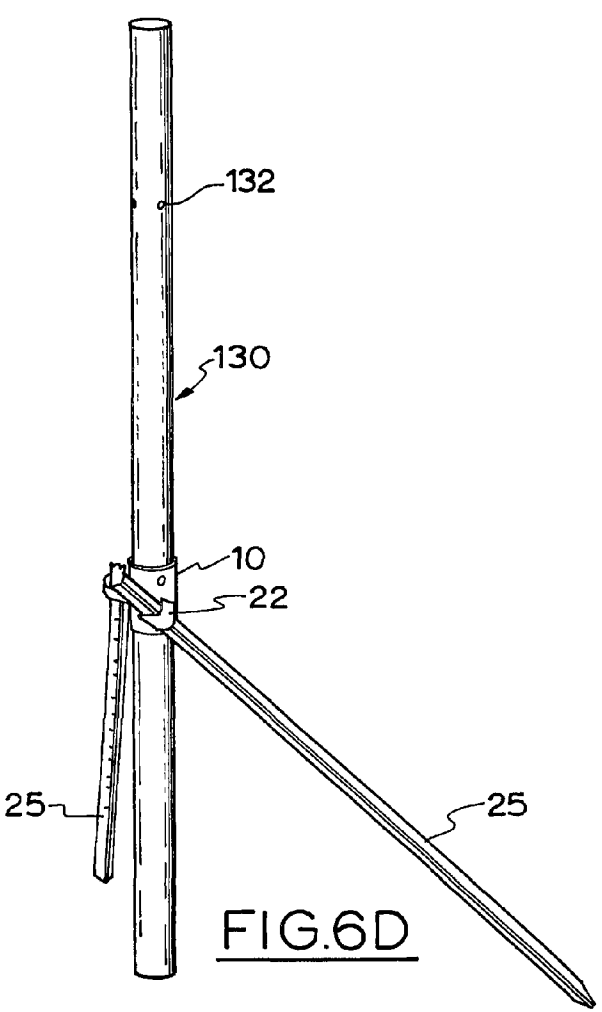
FIGS. 6A to 6D respectively show front, plan, side and in-use perspective views of the bracket of FIG. 1 when secured to the post of FIGS. 5A & B.
Figure 6C:
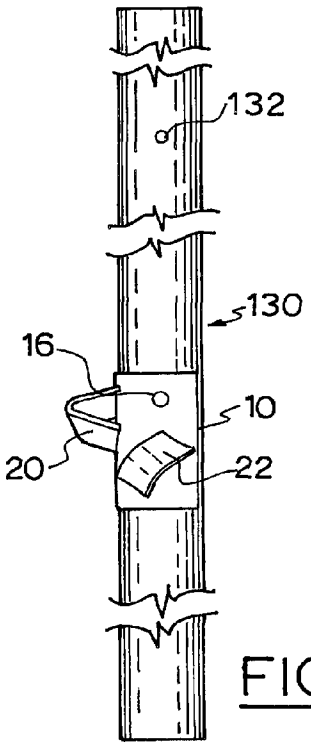
Figure 6B:
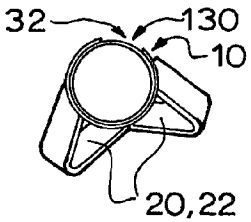
Figure 6A:
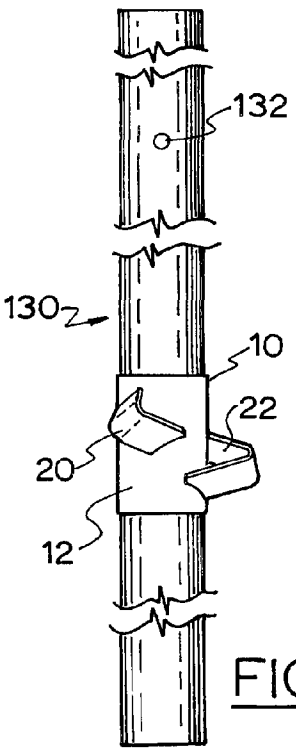
Figure 7D:
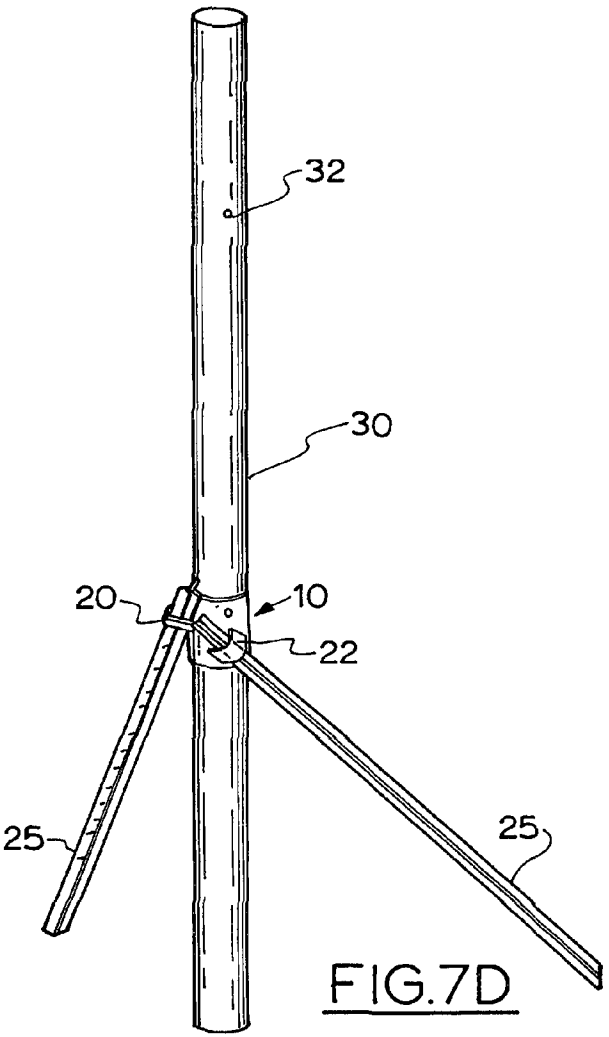
FIGS. 7A to 7D respectively show front, plan, side and in-use perspective views of the bracket of FIG. 2 when secured to the post of FIGS. 5C to 5E.
Figure 7C:
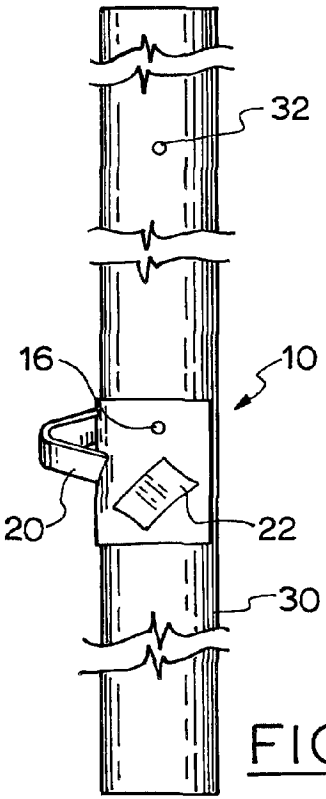
Figure 7B:
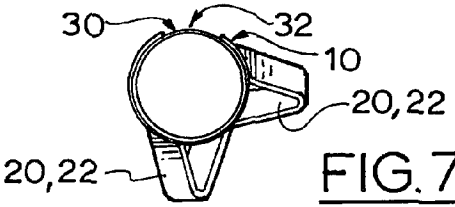
Figure 7A:
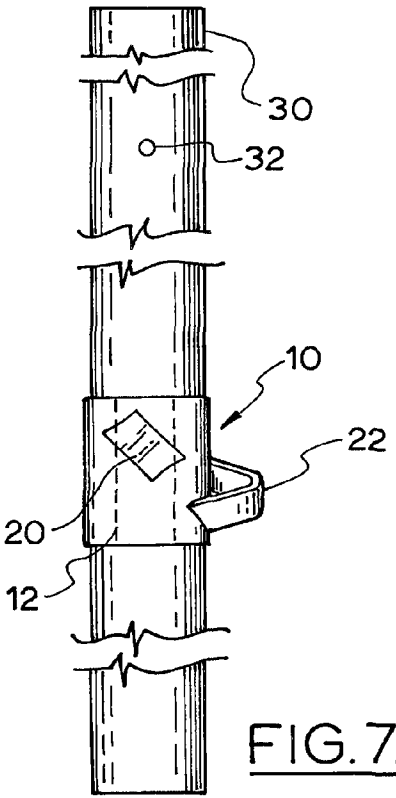

The lugs 20, 22 are further oriented such that, when the bracket is mounted to an elongate post, a centreline through the aperture TA extends downwardly and at an angle with respect to a longitudinal axis of the post (FIGS. 6D & 7D). This sets a skew-angle for the pin 25 when it is driven into the ground (i.e. further ensuring ground retention of the pin).

In an alternative configuration of the bracket, the primary projections can each take the form of a non-looped spaced lug (e.g. a hook-like projection) that is, nevertheless, adapted to retain the pin 25 at the bracket in use.

Referring now to the bracket embodiment of FIG. 2, like reference numerals to FIG. 1 are employed, but the numeral 100 is added thereto (i.e. bracket 10 becomes bracket 110, etc). The bracket 110 of FIG. 2 is similar in most respects to the bracket 10 of FIG. 1, although the bracket 110 has a squat (shorter) configuration compared to bracket 10. The bracket 110 of FIG. 2 can also be optimised to each of the tubes 30, 130 of FIG. 5.

FIG. 2 also illustrates the angles subtended by the lugs 120, 122 to the longitudinal axis $A_x$ of the collar 112 and the angle of opening at the split 114. Also, the dotted lines L on the lugs 120, 122 in FIGS. 2E & F illustrate where the bend first starts in each side of the lug. The circular cut-outs 140 at the end of each side of each of the lugs 120, 122 are also shown, which cut-outs optimise lug mounting to the exterior surface of each of the tubes 30, 130.

Figure 3:
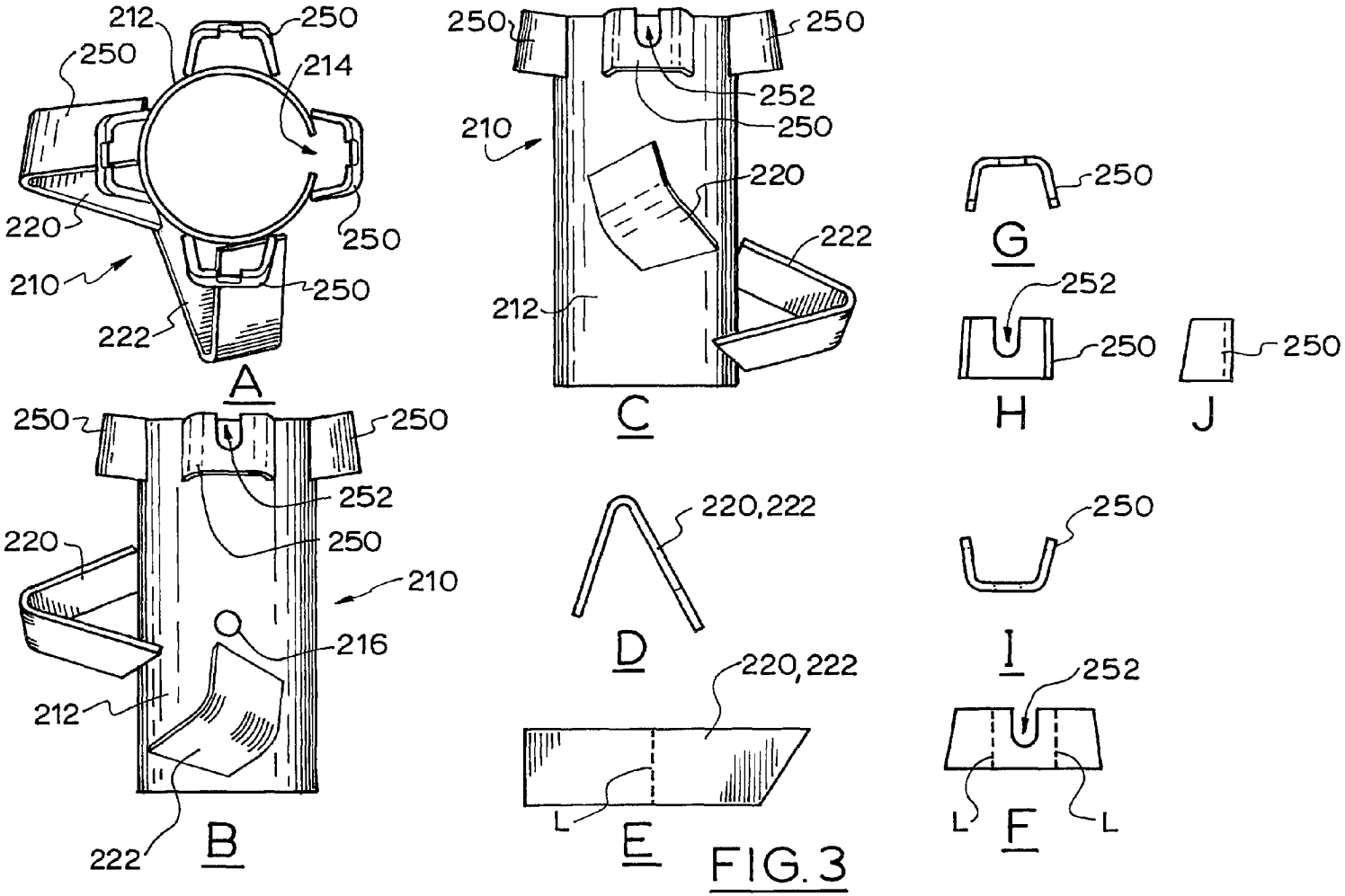
FIGS. 3A to 3C respectively show plan, front and side views of a third bracket embodiment, with FIGS. 9D and 9E showing end and unfolded views of a lug for the bracket of FIGS. 3A to 3C, and with FIGS. 3F to 3J respectively showing unfolded, end, front, reverse end and side views of a secondary lug for the bracket of FIGS. 3A to 3C.
Figure 4C:
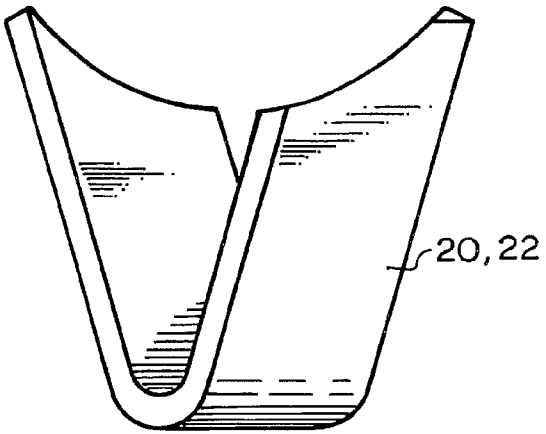
FIGS. 4A to 4C respectively show side, front and perspective views of a lug for the bracket of FIG. 1.
Figure 4B:
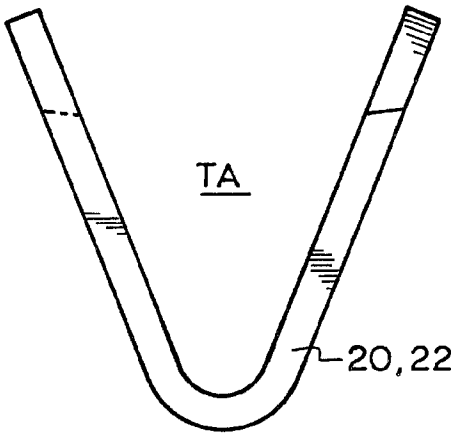
Figure 4A:
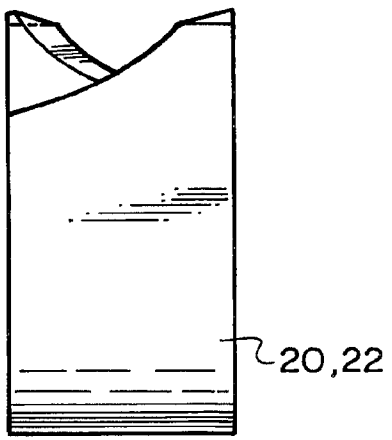
Figure 4D:
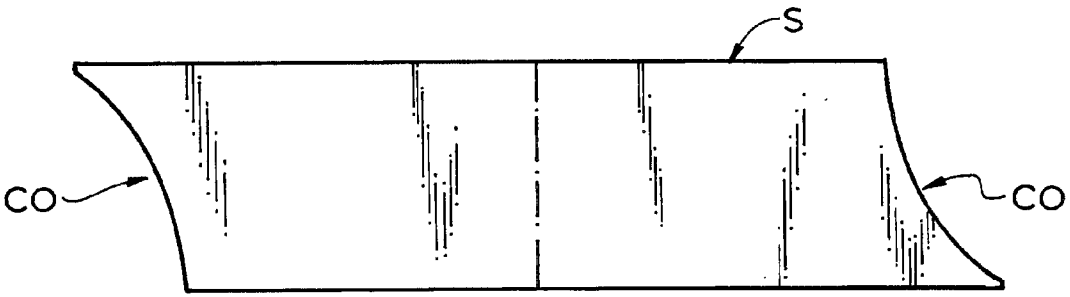
FIG. 4D shows a plan view of a pre-cut strip of material, ready for bending into the lug of FIGS. 4A to 4C.

Referring now to the bracket embodiment of FIG. 3, like reference numerals to FIG. 1 are employed, but the numeral 200 is now added thereto (i.e. bracket 10 becomes bracket 210, etc). The bracket 210 of FIG. 3 is similar in a number of respects to the bracket 10 of FIG. 1, although the bracket 210 has an elongate (longer) configuration than bracket 10. Again, the bracket 210 of FIG. 3 is also optimised to each of the tubes 30, 130.

The bracket 210 of FIG. 3 comprises an additional feature over the brackets 10 and 110. In this regard, the bracket 210 carries four equidistantly spaced secondary lugs 250 located (typically welded) at its in-use upper end to project outwardly therefrom. These secondary lugs 250 are offset by 90° to each other and are each adapted to allow a horizontal tensioning rod R (as described hereafter) to locate and slot into a given one of the lugs, i.e. from one of a "north, south, east or west" direction. In this regard, each lug 250 has an upwardly open slot 252 formed centrally therein that receives an end of the horizontal tensioning rod R therein. The end of rod R may also be specifically adapted (e.g. bent, swaged, etc) to secure into the slot 252. This means that the lower holes that are usually employed in such a tube are no longer required. Thus, the bracket 210 of FIG. 3 provides dual functionality (i.e. secures both pins 25 and rod R).

The bracket 210 of FIG. 3 may be modified to only carry the secondary lugs 250, in which case such a bracket may be used independently of (and together with) any bracket that carries the primary lugs 220, 222 (i.e. such as brackets 10 or 110). Such a bracket may then function solely to replace the post lower holes.

In an alternative configuration of the bracket 210, the secondary lugs 250 can each take the form of a non-looped lug (e.g. a projection with an eyelet) that is, nevertheless, shaped and configured to retain the end of the horizontal tensioning rod R thereat.

Figure 5A:
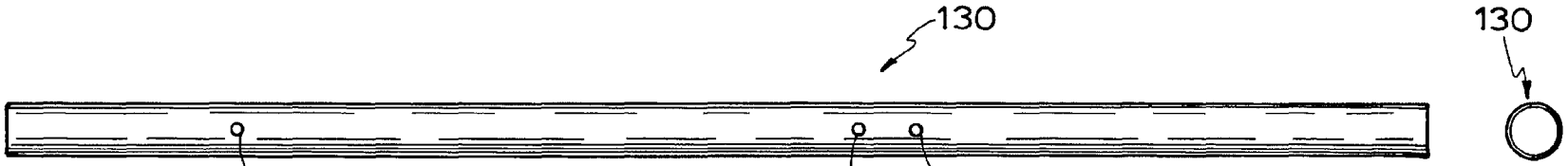
FIGS. 5A and 5B show front and end views of a first elongate strainer post embodiment.
Figure 5B:
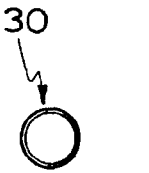
Figure 5C:
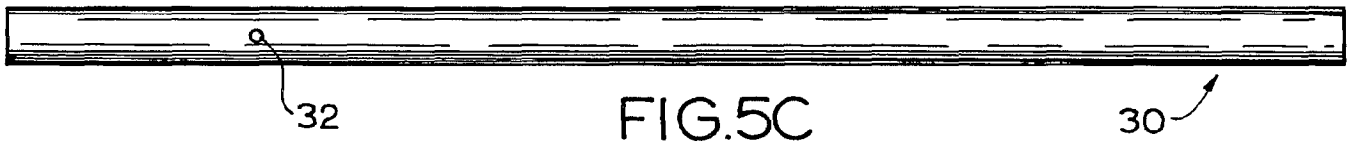
FIGS. 5C to 5E show front, side and end views of a second shorter strainer post embodiment.
Figure 5D:
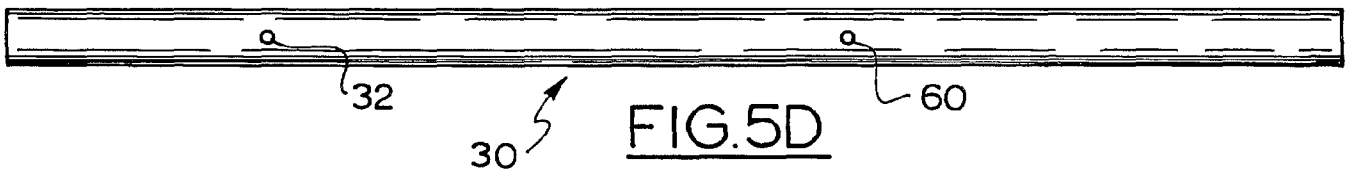
Figure 5E:
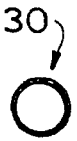

The tube 130 of FIGS. 5A & B is elongated over the tube 30 of FIGS. 5C-E. Because of its increased length, tube 130 is suitable for use in soft ground (e.g. sandy soils) to provide extra depth of insertion and thus better securement/retention in the ground. The tube 30 is used in "conventional" soils (i.e. typical use applications).

The tube 30 is provided with one series of lower pilot holes 60 for bracket attachment thereto (e.g. by self-tapping screws driven through the holes 16). On the other hand, the tube 130 is provided with two spaced series of lower pilot holes 160 for enabling adjustment of the bracket attachment location to the tube depending on how far the tube has needed to be inserted into the ground by the user. Again, the attachment can be by way of by self-tapping screws driven through the holes 16.

The tubes 30, 130 each comprise a line of e.g. four holes 32, 132 located towards the in-use upper end of the tube. These holes can each receive a respective stay ST therethrough as described hereafter with reference to FIGS. 8-10.

Figure 8:
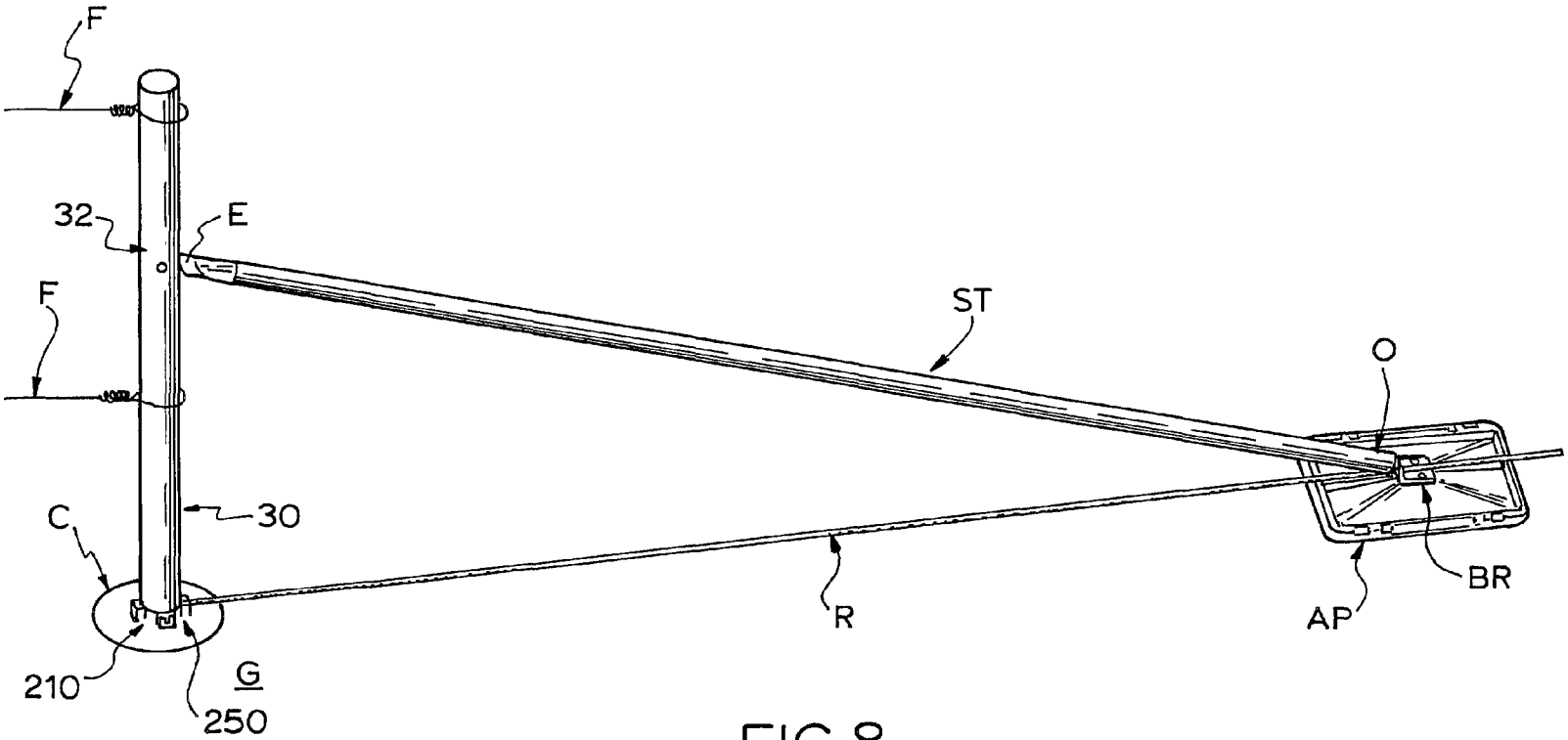
FIG. 8 shows a perspective view of a first (single) stay assembly employing the bracket of FIG. 3 and post of FIG. 7.

In use, the tube 30, 130 is driven into the ground G at its lower end. The bracket 10 is then positioned (e.g. slid) thereon to sit on the tube adjacent to, but usually to be at least partially embedded in, the ground G (FIGS. 8 and 9). Then, the ground-securing pins 25 are each inserted and driven home through the lugs 20, 22 using a suitable tool (e.g. a hammer) to the depth as best illustrated in FIG. 9. The tube 30, 130 may then optionally be cemented C (FIGS. 8 & 9).

Figure 10:
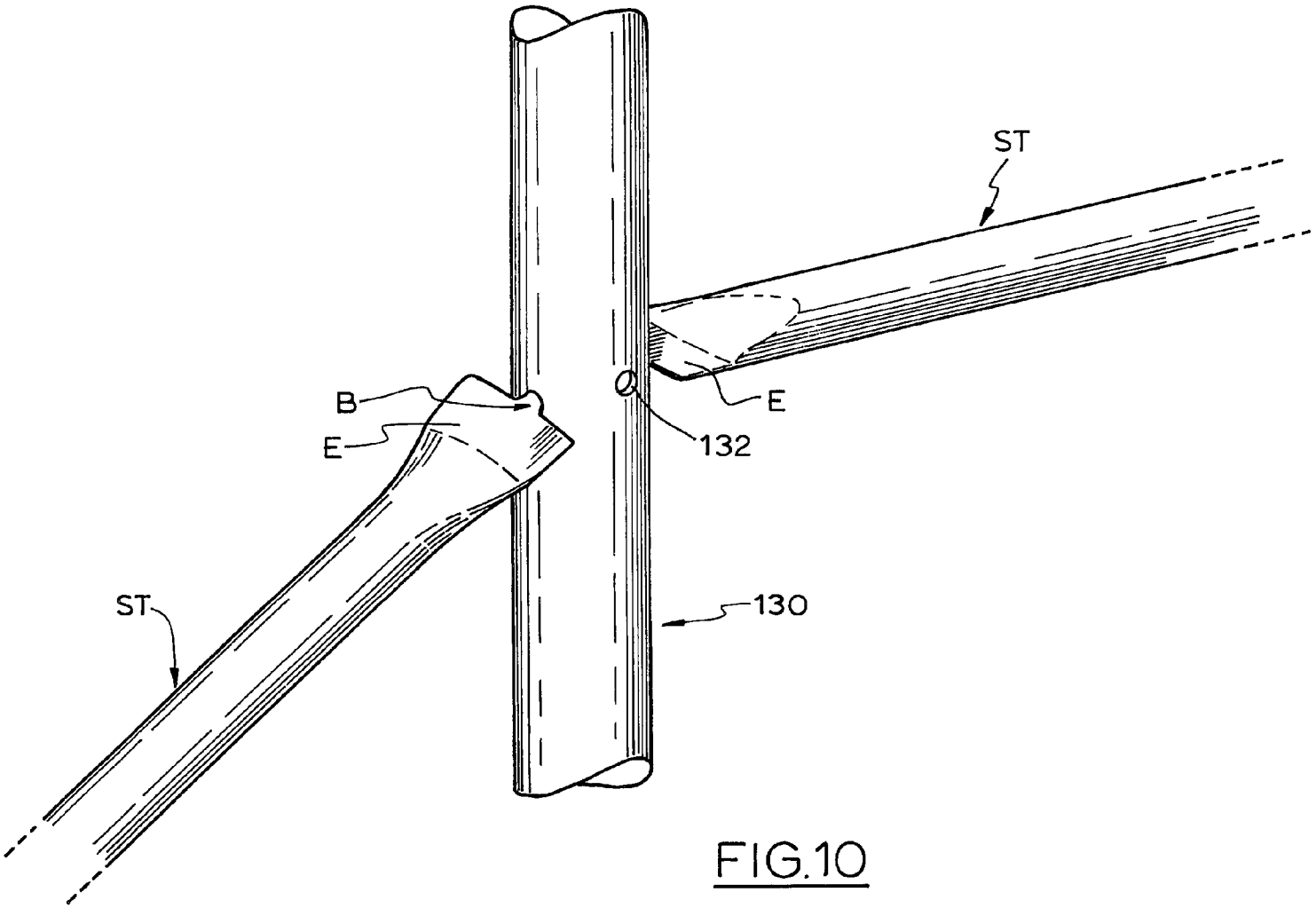
FIG. 10 shows a first detail of the stay assembly of FIG. 9.

As best shown in FIG. 10, a respective stay ST is located in one of the four holes 32, 132 located towards the in-use upper end of the tubes 30, 130. In this regard, a protruding bit B of a swaged end E of the stay is inserted into one of the holes 32, 132.

Figure 11:
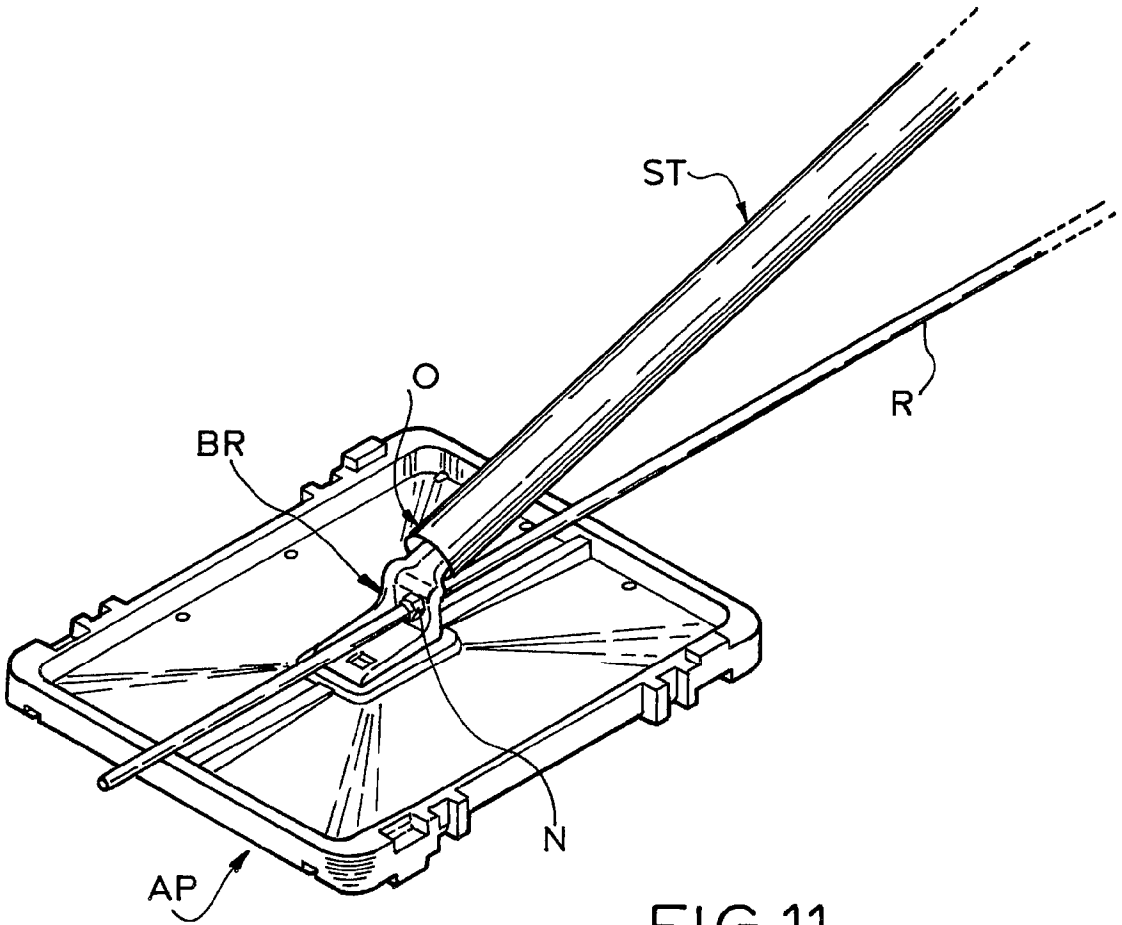
FIG. 11 shows a second detail of the stay assembly of FIG. 9.

As best shown in FIG. 11, an opposing open end O of the stay ST is secured to a strainer assembly plate AP via a bracket BR mounted to the plate (i.e. a projection of the bracket BR locates in the open end O). The strainer assembly plate AP allows thrust from the post to be transferred via the stay ST to the ground, and so is also referred to as a thrust pad.

A first end of an externally threaded horizontal tensioning rod R is inserted to extend through the bracket BR, and the rod is secured to the bracket via a tensioning nut N. The rod R extends out from the strainer assembly plate AP, with the other end of rod R being secured to the tube 30, 130. As mentioned above, usually this securement is via one or both of opposed lower holes defined in the tube 30, 130. However, by employing the bracket of FIG. 3, the other end of rod R can be secured to the tube via the secondary lugs 250. The rod is then tensioned by tightening of the nut N at bracket BR, compressing the stay ST. This set-up allows for the transfer of thrust from the post to the ground in use via the stay ST and plate AP.

FIG. 8 shows a "single" stay assembly employing just one stay ST, rod R and plate AP. Just one of the four holes 32 supports the stay ST at tube 30. In FIG. 8, the tube 30 can support e.g. a wire fence F thereat, or a gate, etc.

FIG. 9 shows a "dual" stay assembly, employing opposing stays ST, rods R and plates AP with the tube 130. An opposing two of the four holes 132 support a respective stay ST. The four holes also allow for up to four stays to be employed with the one tube.

Each of the brackets 10, 110 and 210 can carry secondary lugs. Each primary or secondary lug may also be adapted (i.e. reshaped and reconfigured) to secure both the pin 25 and end of rod R thereat simultaneously. In this regard, the lug can define an aperture that is shaped and configured to the pin profile, but that also has a slot to initially receive therein the tensioning rod end (i.e. prior to inserting and driving the pin therethrough). Further, once the pin has been inserted, it can function to secure the tensioning rod end at the projection.

Whilst a post in the form of a tube/pipe has been shown and described, in the same strainer-type applications, or in different applications, an alternative post may be employed. For example, a Y- or T-profiled fence post can be employed that is e.g. hot roll-formed from steel. A post may be employed that is formed from concrete, etc. The bracket (e.g. the collar/clamp) is changed and adapted accordingly.

Whilst the tube/pipe 30, 130 is suitable for use in fencing applications it should be appreciated that it is not in any way limited to such applications, and may be used as part of a retaining wall system, in construction etc.

Whilst strainer-type posts are depicted in the drawings, it should be understood that the bracket, system and method as disclosed herein can be applied to a range of elongate members including rails, cross-members, stays, channels, struts, and for the different applications outlined.

Further, whilst a number of specific bracket, system and method embodiments have been described, it should be appreciated that the bracket, system and method may be embodied in other forms.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the mounting bracket, system and method as disclosed herein.

The invention claimed is:

1. A bracket for a post, the bracket comprising:

a body able to be located at the post; and at least one primary projection extending out from the body, each primary projection comprising a strip of material that defines an aperture between the body and the material that is able to receive therethrough and retain thereat a ground securing pin; and at least one secondary projection extending out from the body, each secondary projection comprising a strip of material that defines an aperture between the body and the material, the strip of material further comprising a slot cut partway thereinto that is able to receive and retain an end of a tensioning rod therein, whereby the slot is located in a portion of the strip of material that is directly adjacent to the aperture defined between the strip of material and the body.

2. The bracket as claimed in claim 1 that comprises at least two primary projections extending out from the body, whereby, when a centreline is taken through the aperture of each primary projection, the centrelines of adjacent apertures extend at an angle to each other.

3. The bracket as claimed in claim 2 wherein the adjacent centrelines of adjacent apertures extend generally at right angles to each other.

4. The bracket as claimed in claim 1 that comprises up to four secondary projections extending out from the body.

5. The bracket as claimed in claim 1 wherein the slot of each secondary projection is defined in the strip of material intermediate its ends.

6. The bracket as claimed in claim 1 that comprises at least two primary projections and at least two secondary projections extending out from the body, wherein each primary or secondary projection extends out from the body at a location that is approximately 90° offset to the location of an adjacent respective primary or secondary projection.

7. The bracket as claimed in claim 1 wherein the body is able to be slid along and then secured against movement with respect to the post.

8. The bracket as claimed in claim 7 wherein the body is a collar having an aperture therethrough that is sized to snugly receive the post therein and such that the collar can be slid along and secured to the post at a given position.

9. The bracket as claimed in claim 8 wherein the collar is a split collar.

10. The bracket as claimed in claim 8 wherein the collar is circular, having a circular aperture therethrough to enable it to be slidably positioned along a circular post.

11. The bracket as claimed in claim 8 wherein the collar comprises one or more locator holes, each for receiving a securing screw therethrough to enable the collar to be secured against sliding movement with respect to the post.

12. The bracket as claimed in claim 1 wherein for each primary projection the strip of material is oriented such that, when the bracket is mounted to an elongate post, a centreline through the aperture extends downwardly and at an angle with respect to a longitudinal axis of the post, and for each secondary projection, the strip of material is oriented such that, when the bracket is mounted to an elongate post, a centreline through the aperture extends parallel to the longitudinal axis of the post.

13. The bracket as claimed in claim 1 wherein, for each primary projection, when viewed from its opening, the aperture defined by the strip of material, is generally triangular-shaped or trapezoidal-shaped.

14. The bracket as claimed in claim 13 wherein the general triangular-shape extends right through the projection and is adapted to receive a pin therethrough in the form of a bar having a Y-profile or a T-profile.

15. The bracket as claimed in claim 14 wherein the bar having a Y- or T-profile is itself a discrete length of fence post.

16. A post securement system, the system comprising at least one bracket as defined in claim 1, at least one a ground securing pin and at least one tensioning rod for retention at the bracket.

17. The system as claimed in claim 16 further comprising a post arranged such that, when the post is located in ground, the bracket is able to be located at the post adjacent to or in the ground, whereby the at least one ground securing pin can be retained at the bracket and also be inserted into the ground, and whereby the tensioning rod can be retained at the bracket.

18. The system as claimed in claim 17 wherein the bracket is able to retain at least two ground securing pins, each at a respective primary projection of the bracket, and is able to retain one tensioning rod at a respective secondary projection of the bracket whereby, when the bracket is located along the post adjacent to or in the ground, each ground securing pin and tensioning rod end is able to be retained at the bracket and the pins are also able to be inserted into the ground.

19. The system as claimed in claim 18 wherein the primary projections are arranged on the bracket whereby, when the bracket is positioned on the post adjacent to the ground, and the at least two pins have been retained at the bracket and also inserted into the ground, adjacent pins in adjacent primary projections generally project at right angles to each other, when the post is viewed in end profile.

20. The system as claimed in claim 19 wherein, for each primary projection, the strip of material is oriented such that a centreline through the aperture extends downwardly and at an angle with respect to a longitudinal axis of the post whereby, in use, an elongate axis of each pin extends downwardly and at an angle with respect to the post longitudinal axis, and for each secondary projection, the strip of material is oriented such that a centreline through the aperture extends parallel to the longitudinal axis of the post.

21. The system as claimed in claim 16 wherein the or each ground securing pin is defined by a discrete length of fence post having a Y-shaped or T-shaped profile.

22. The bracket as claimed in claim 1 wherein the slot extends in the same direction as a longitudinal axis of the body.

23. The bracket as claimed in claim 1 wherein the primary projection is spaced from the secondary projection along the body such that the primary projection is positioned adjacent to a lower end of the body and the secondary projection is positioned adjacent to an upper end of the body, in use.

24. A method of securing a post in ground, the method comprising the steps of:

(i) locating the post in the ground;

(ii) locating a bracket as defined in claim 1 along the post adjacent to or in the ground;

(iii) positioning at least one ground securing pin to be retained at the bracket and also to be inserted into the ground, and positioning at least one tensioning rod to be retained at the bracket.

25. The method as claimed in claim 24 wherein in step (ii) the bracket body is inserted over a top end of the post, with the post being received though an aperture of the body, and then the bracket is slid along the post until it sits adjacent to or at least partially in the ground, whereupon the bracket is secured to the post against sliding.

26. The method as claimed in claim 24 wherein in step (iii) the or each ground securing pin is inserted through a respective primary projection and is driven into the ground, and an end of the or each tensioning rod is inserted into the slot defined in a respective secondary projection.

27. A bracket for a post, the bracket comprising:

a body able to be located at the post; and at least one primary projection extending out from said body, each primary projection comprising a strip of material that defines an aperture therethrough between said body and the material that is able to receive therethrough and retain thereat a ground securing pin; and at least one secondary projection extending out from said body, each secondary projection comprising a strip of material that defines an aperture therethrough between said body and the material that is able to receive an end of a tensioning rod therein, wherein the primary projection is spaced from the secondary projection along the said body, such that the primary projection is positioned adjacent to a lower end of said body and the secondary projection is positioned adjacent to an upper end of said body, in use.

28. A bracket as claimed in claim 27, wherein an axis through the primary projection aperture is skewed to a longitudinal axis of said body, and an axis through the secondary projection aperture is parallel with the longitudinal axis of said body.

29. A bracket as claimed in claim 27, wherein the secondary projection further comprises a slot cut partway into the strip of material such that the slot extends in the same direction as a longitudinal axis of said body.

30. A bracket for a post, the bracket comprising:

a body able to be located at the post; and at least one projection extending out from the body, each projection comprising a strip of material that defines an aperture between the body and the material able to receive therethrough and retain thereat a ground securing pin, the strip of material further comprising a slot cut partway thereinto that is able to receive and retain an end of a tensioning rod therein, whereby the slot is located in a portion of the strip of material that is directly adjacent to the aperture defined between the strip of material and the body.

31. The bracket as claimed in claim 30 wherein an axis through the projection aperture is skewed to a longitudinal axis of the body, and the slot extends in the same direction as the longitudinal axis of the body.

* * * * *